US006868855B2

(12) United States Patent
Shafer et al.

(10) Patent No.: US 6,868,855 B2
(45) **Date of Patent: *Mar. 22, 2005**

(54) CIGARETTE WITH SMOKE CONSTITUENT ATTENUATOR

(75) Inventors: Kenneth Shafer, Midlothian, VA (US); San Li, Midlothian, VA (US); Milton Parrish, Midlothian, VA (US); Susan Plunkett, Richmond, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/725,075

(22) Filed: Dec. 1, 2003

(65) Prior Publication Data

US 2004/0112396 A1 Jun. 17, 2004

Related U.S. Application Data

(63) Continuation of application No. 09/853,406, filed on May 11, 2001, now Pat. No. 6,701,936.
(60) Provisional application No. 60/203,302, filed on May 11, 2000.

(51) Int. Cl.[7] ..... A24D 1/00; A24C 5/00
(52) U.S. Cl. ..... 131/361; 131/363; 131/365
(58) Field of Search ..... 131/360–365; 162/139

(56) References Cited

U.S. PATENT DOCUMENTS

| | | | | | |
|---|---|---|---|---|---|
| 3,667,479 | A | | 6/1972 | Sanford et al. | |
| 3,722,515 | A | | 3/1973 | Reynolds et al. | |
| 3,902,504 | A | | 9/1975 | Owens, Jr. et al. | |
| 3,911,932 | A | | 10/1975 | Houck, Jr. et al. | |
| 4,407,308 | A | | 10/1983 | Baker et al. | |
| 4,779,631 | A | | 10/1988 | Durocher et al. | |
| 5,065,777 | A | * | 11/1991 | Owens, Jr. | 131/365 |
| 5,109,876 | A | * | 5/1992 | Hayden et al. | 131/365 |
| 5,370,139 | A | | 12/1994 | Shu et al. | |
| 5,829,453 | A | * | 11/1998 | White et al. | 131/359 |
| 5,997,671 | A | | 12/1999 | Takeuchi et al. | |
| 6,026,820 | A | | 2/2000 | Baggett, Jr. et al. | |
| 6,138,684 | A | * | 10/2000 | Yamazaki et al. | 131/365 |
| 6,289,898 | B1 | | 9/2001 | Fournier et al. | |
| 6,701,936 | B2 | * | 3/2004 | Shafer et al. | 131/361 |

* cited by examiner

*Primary Examiner*—Peter Chin
*Assistant Examiner*—Carlos Lopez
(74) *Attorney, Agent, or Firm*—Connolly Bove Lodge & Hutz LLP

(57) ABSTRACT

Smoke constituent reduction is achieved by resolving from puff-to-puff analysis at which location along a tobacco rod production of a particular smoke constituent is maximized, and locally applying an attenuator at said resolved location to reduce production of the constituent. A remainder of the rod is left untreated so as to minimize impact on taste and burn characteristics of the cigarette. Reduction of the first puff formaldehyde formation is achieved by treating the cigarette tip with salts, using Burley tobacco in the tip, increasing the rod density, ventilation at the tip, and thermal treatment of the tip. Other classes of smoke constituents such as TSNAs (tobacco specific nitrosamines), PAHs (polycyclic aromatic hydrocarbons), etc., in particular the PAHs of naphthalene, phenanthrene, pyrene, flouranthene and benzo(a)pyrene may be reduced with placement of a carbon-based and/or metallic disc at the tip and with practices of the invention herein.

5 Claims, 7 Drawing Sheets

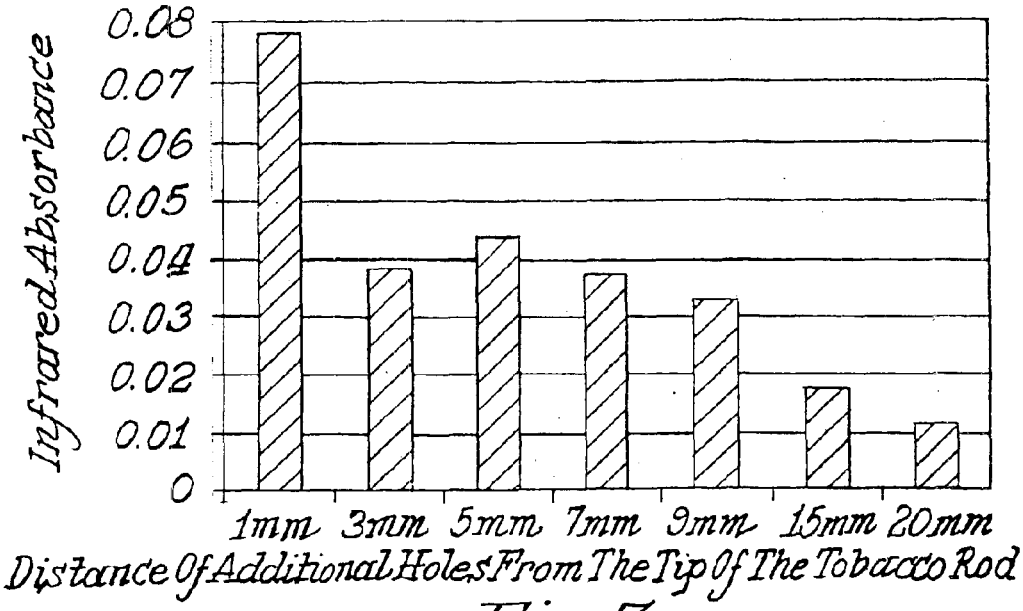
Fig. 7.
Fig. 11A.
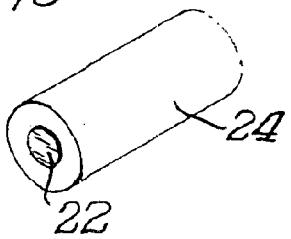
Fig. 11B.
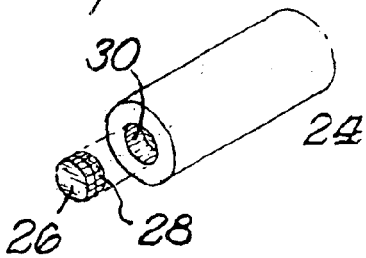
Fig. 11C.
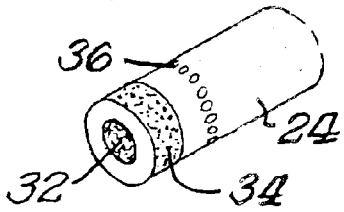
Fig. 11D.
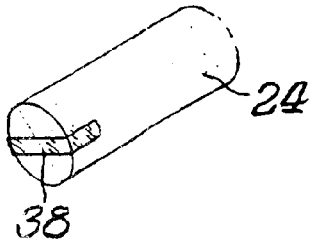
Fig. 11E.
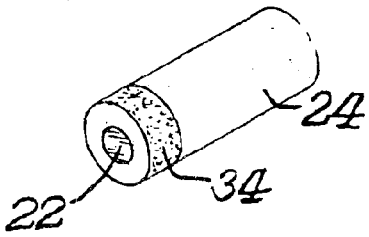
Fig. 11F.
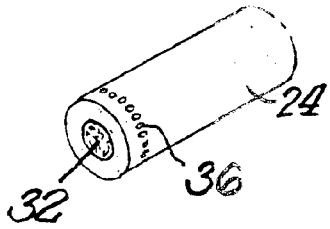

CIGARETTE WITH SMOKE CONSTITUENT ATTENUATOR

CROSS REFERENCE TO RELATED APPLICATION

The present application is a continuation of application Ser. No. 09/853,406, filed May 11, 2001, now U.S. Pat. No. 6,701,936, which claims the benefit of provisional Application Ser. No. 60/203,302 filed May 11, 2000.

BACKGROUND OF THE INVENTION

The concentration of mainstream smoke constituents changes on a puff-by-puff basis starting with the lighting puff and progressing down the rod. It is desirable to selectively reduce certain compounds which occur at significantly higher concentrations in one or two puffs of a cigarette.

SUMMARY OF THE INVENTION

Smoke constituent reduction is achieved by resolving from puff-to-puff analysis at which location along a tobacco rod production of a particular smoke constituent is maximized, and locally applying an attenuator at said resolved location to reduce production of the constituent. A remainder of the rod is left untreated so as to minimize impact on taste and burn characteristics of the cigarette.

It is known that taste is dependent on the delivery of total particulate matter (TPM) of cigarette smoke. However, approaches that are applied to the entire cigarette, such as filter ventilation, will reduce smoke components as well as the TPM in the same manner. In this invention, particulate matter from the initial puff can be significantly reduced without significantly effecting the cigarette TPM, thus preserving the taste.

For example, it has been discovered that 40–50% of the formaldehyde found in mainstream tobacco smoke of cigarettes is formed in the first puff. The present invention includes a host of embodiments that address how to adjust a region/zone of the rod corresponding to the first puff such that its contribution of formaldehyde due to pyrolysis/combustion is reduced. It is to be realized that the first puff event is compounded with the act of lighting the cigarette, a process that greatly affects the first puff deliveries of smoke components.

A selective reduction is accomplished by changing the composition of the tobacco filler by only one or two puffs without significantly changing the remaining puffs of the cigarette. In this way, the average delivery level and taste of the cigarette is not changed significantly.

Since 40–50% of the formaldehyde occurs in the lighting or first puff, any one or a combination of cigarette modifications made at the front (lit) end of the tobacco rod will reduce formaldehyde. These modifications include the introduction of an ammonium-source compound, such as ammonium bicarbonate to the tip of the tobacco rod, the addition of alkali metal salts (fire retardants) such as potassium bicarbonate or potassium phosphate, the replacement of a portion of the tobacco blend at the front of the cigarette with a tobacco product having a relatively high level of ammonia, such as Burley, or Bright expanded with ammonia and/or reconstituted tobacco blend (RCB). In addition, yet another approach is to add a reconstituted tobacco blend to the tip in the form of a circular disc attached to the end of the rod. Still another approach is the introduction of ventilation holes or an increase in permeability in the paper outer wrap near the tip to dilute only the lighting puff, and an increase in filler density in the tobacco at the front of the rod.

The amount of formaldehyde formed during a puff is dependent upon the heating rate, the amount of tobacco and char consumed, the temperature of the tobacco prior to the puff, and the amount of condensate on the rod behind the coal. The first puff is distinctly different when considering each of these conditions. The concentration of formaldehyde increases with increasing heating rate. The increase in heating rate of the lighting puff compared to subsequent puffs in which the coal is established results in an increase in concentration. More formaldehyde can be expected to be produced in the first puff because the tobacco is being heated from room temperature whereas in subsequent puffs the tobacco located directly behind the coal is already at elevated temperatures as a result of the static burn. Char that is burnt in these puffs following the lighting puff produces very little formaldehyde compared to tobacco. Because the level of condensate on the cigarette rod in the first puff is significantly less (no accumulation possible from previous puffs) than in subsequent puffs, the effect of rod filtration also is diminished resulting in increased levels of formaldehyde.

In a first embodiment, laser perforations or other forms of perforations are established about the periphery of the free end of the cigarette adjacent the tip. Preferably, the perforations are located sufficient distance to be wholly operative throughout the first puff, but close enough to disappear prior to the second puff. Preferably, the perforations are placed 3 mm to 7 mm from the free end of the cigarette.

If one accepts that approximately 50% of formaldehyde is generated in a particular cigarette during the first puff smoked under FTC conditions, then perforations configured to produce a 50% dilution level (at the tip) may achieve a 25% reduction in the total cigarette delivery of formaldehyde. Too much ventilation at the tip may create difficulties with lighting the cigarette and produce a puff having little or no taste. The pressure drop from the tip of the cigarette to the ventilation holes can be increased by placing a circular piece of RCB rich in ammonium salt or metal foil whose diameter is less than that of the cigarette of the tip.

In another embodiment ammonium salts are utilized in the tobacco rod which release ammonia when heated. The released ammonia reacts with the formaldehydes to remove the latter from mainstream smoke. It is envisioned that the ammonium salts would be added either with or without a solvent, preferably without a solvent. Preferred salts include ammonium bicarbonate, sodium chloride, potassium bicarbonate and potassium phosphate.

With ammonium bicarbonate, one can remove approximately 90% of the 50% first puff contribution of formaldehyde.

Yet another embodiment which utilizes an alkali metal salt (e.g., sodium chloride) to modify the breakdown of cellulose. The cation is believed to be the operative portion of the salt in the chemical events.

In the salt embodiment, such might be mechanically rubbed into free ends of the cigarettes, injected, painted, or applied using a moving orifice device such as described in U.S. Pat. No. 5,997,671 to create striped cigarette paper. The disclosure of U.S. Pat. No. 5,997,671 is incorporated herein by reference. During cigarette making operations, the cigarette rod forming machinery includes registration of the stripes with tobacco rod portions that correspond to the free end portions of the completed cigarettes. Preferably, the stripe is approximately 3 to 7 mm wide or possibly wider.

Another embodiment includes tipping the free end of the cigarette with tobacco having high ammonia, low sugar, such as burley tobacco or some forms of reconstituted tobaccos. Upon lighting a cigarette comprising a plug of Burley tobacco at the tip (or a tip comprising an elevated Burley content), ammonia is released, which reacts with the formaldehyde to alleviate the latter.

Another embodiment includes employment of magnesium ammonium phosphate as filler in paper at the tip or as an addition throughout the tobacco rod or a portion thereof. Copending, commonly assigned, U.S. application Ser. No. 09/399,159, filed Sep. 20, 1999, describes such paper, and text of this application is incorporated herein by reference.

A fundamental aspect of all these embodiments is a process of: resolving at which location along a tobacco rod (corresponding to a one or more of a puff count) where the target (preselected) smoke constituent is maximized; and applying an inhibitor/attenuator of the target smoke constituent at the corresponding rod location. It should be realized that other classes of smoke constituents in either the gas or particulate phases of smoke may maximize at locations other than the free end or tip of the cigarette, and accordingly, the cigarette would be modified at such other locations.

Additionally, it has been discovered that the levels of benzo(a)pyrene (BaP) present in the first puff in mainstream tobacco cigarette smoke approximately equal the sum of the rest of the puffs when using a yellow flame lighting source under laboratory cigarette smoking conditions. Polycyclic aromatic hydrocarbons (PAHs), including BaP, may be reduced in the first or lighting puff by minimizing or eliminating the direct contact of a yellow flame from a match or a gas lighter during lighting. The PAHs produced in the first puff of a cigarette are reduced by lighting with an electric lighter, by modifications made to the cigarette which include attaching a circularly shaped piece of carbon-based and/or metallic material (1 to 2 mm less in diameter than the cigarette) to the center of the tip, replacing the tobacco in the tip with an alternate fuel source that produces no or very low levels of PAHs, placing a catalytic material in the tip to increase the combustion efficiency of the flame, and placing ventilation holes in the paper near the tip as described previously in the discussion on formaldehyde reduction.

The concentration of mainstream smoke constituents changes on a puff-by-puff basis starting with the lighting puff and progressing down the rod. Furthermore, those compounds which occur at significantly higher concentrations in one or two puffs of a cigarette can be reduced selectively by modifying only that portion of the cigarette corresponding to those puff(s). It has been found since then that benzo(a)pyrene, pyrene, phenanthrene, and naphthalene can be at significantly higher levels in the first puff or lighting puff than the other puffs, depending upon the lighting source, the position of the flame to the cigarette tip, and the duration of flame contact during the puff. Lighting a cigarette with a match increases the level of these compounds by a factor of 22, 7, 6 and 4 in the first puff, respectively, compared to an electric lighter. A butane lighter that delivers a yellow flame (indicative of incomplete combustion) increases these compounds in the first puff by a factor of 6,3,3, and 3 over an electric lighter. A reference cigarette lit with a yellow flame by a match or with a butane lighter that produces a yellow flame and, which is smoked under FTC conditions, produces an approximately two fold increase in benzo(a)pyrene for the whole cigarette compared to one lit by an electric lighter. It has been discovered that these results with a yellow flame butane lighter are dependent upon position of the cigarette relative to the blue and yellow portions of the flame.

Reduction of the first puff formaldehyde formation is achieved by treating the cigarette tip with salts, using Burley tobacco in the tip, increasing the rod density, ventilation at the tip, and/or thermal treatment of the tip. Reduction of BaP in the first puff of mainstream smoke is achieved by selecting a lighter using a blue flame (not yellow), replacing the tobacco in the tip with an alternate fuel source that produces no or very low levels of PAHs, blocking the end with a thin (~1 mm) circularly shaped carbon-based disc placed on the tip, placing ventilation holes at the tip, or placing a catalyst in the filler at the tip end. The fact that the first puff is quite different from the rest of the puffs in a cigarette smoking process, in terms of temperature rise, materials consumed, tobacco conditions, and filtration, makes it possible to modify only the portion of cigarette corresponding to the first puff to selectively reduce the compounds that have significantly higher deliveries from the first puff without changing the majority of the cigarette or the smoke chemistry.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawing in which:

FIG. 7 is a graph showing infrared absorbance of formaldehyde in the first puff of mainstream smoke of 1RAF cigarettes with additional holes at different distance from the tobacco rod tip;

FIGS. 11A through 11F illustrate alternate embodiments of the present invention.

DETAILED DESCRIPTION OF THE INVENTION

Figure 1:
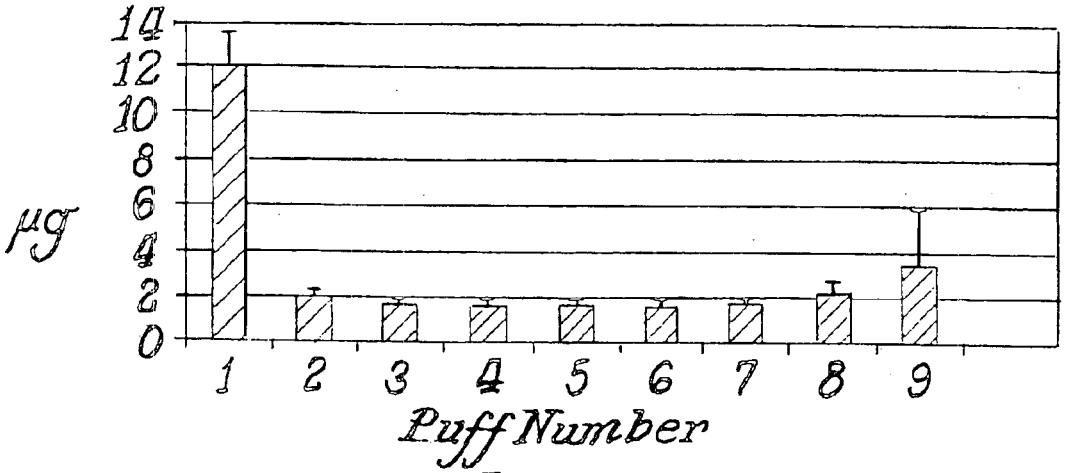
FIG. 1 is a graph showing formaldehyde deliveries in mainstream smoke of IR4F cigarettes at different puffs.

Not wishing to be bound by theory, it is believed that the amount of formaldehyde formed during a puff is dependent upon the heating rate, the amount of tobacco and char consumed, the temperature of the tobacco prior to the puff, and the amount of condensate on the rod behind the coal. The first puff is distinctly different when considering each of these conditions. The concentration of formaldehyde increases with increasing heating rate. The increase in heating rate of the lighting puff compared to subsequent puffs in which the coal is established results in an increase in concentration. More formaldehyde is produced in the first puff because the tobacco is being heated from room temperature whereas in subsequent puffs the tobacco located directly behind the coal is already at elevated temperatures as a result of the static burn. Char that is burnt in these puffs following the lighting puff produces very little formaldehyde compared to uncharred tobacco. Because the level of condensate on the cigarette rod in the first puff is significantly less than in subsequent puffs, the effect of rod filtration is diminished resulting in increased levels of formaldehyde.

Ammonium salts and burley tobacco release ammonia which then reduces the level of formaldehyde by reaction. Formaldehyde is reduced through the selective treatment of the front of the cigarette such that the remainder of the cigarette is essentially left unchanged. Salts can be applied to this portion of the cigarette rod which if used throughout the cigarette rod would cause the coal to extinguish or have an impact on taste of the cigarette.

During a cigarette smoking process, the first puff yields a large amount of formaldehyde, while the later puffs only show small amounts of formaldehyde formation. This phenomenon is explained by selective filtration of formaldehyde gas by tobacco rod and the condensation of tarry products on the tobacco rod, and also by the interaction of formaldehyde with the materials generated behind the coal. During the lighting puff, the formaldehyde formed passes through a fresh tobacco rod where the filtration is only conducted by the tobacco shreds, little char has formed and no condensate exists during the first puff. In consecutive puffs after lighting, where a static burning coal is established, there is a condensation of tarry products built up on the tobacco rod, and the condensation increases as the puff count increases. Those tarry condensations selectively absorb formaldehyde gas (and other gases), and the formaldehyde interacts with the materials behind the coal, so the gas phase formaldehyde detected drops tremendously after the first puff (the lighting puff).

Differences between the first puff and rest of the puffs during a cigarette smoke process explains the gas phase formaldehyde detected on a per puff base. The heating rate, tobacco thermal treatment, and tobacco/char consumed during a puff were found to play important roles on the mainstream gas phase formaldehyde detected. For example, the heating rates experienced by the tobacco shreds during the lighting puff, where temperature increases from room temperature to around 950° C. in a fraction of second, is very different from that of the rest of the puffs, where a coal and a temperature gradient had been established. Also, the amounts of fresh tobacco consumed during the first puff and the rest of the puffs are quite different. During the lighting puff, only fresh tobacco is burned, but in consecutive puffs, a mixture of tobacco and charred material is consumed as well. Another factor is that during the static burn after the coal is established or after the first puff, the tobacco behind the coal is exposed to elevated temperature. In other words, the tobacco is thermally treated and no longer fresh before the next puff. Those factors, combined with the previously proposed selective filtration and interaction theory, provide a more complete picture and explanation on the observed difference in amounts of formaldehyde from the first puff and consecutive puffs. With more understanding of the differences between the first puff and the remainder of the puffs, it is now possible to modify only that portion of cigarette corresponding to the first puff to selectively reduce the compounds that have significantly higher deliveries from the first puff without changing the overall delivery and taste of the cigarette. The taste of the mainstream smoke is dependent on the total particulate matter (TPM). While modifications to a cigarette discussed in this invention reduce selected compounds as well as the particulate matter in the first puff, there will be little affect on the TPM of the modified cigarette. One such compound is formaldehyde, of which a large portion occurs in the first puff. Another compound is benzo (a) pyrene (BaP), which is present in large amounts in the first puff relative to all subsequent puffs when the cigarette is lit using a yellow flame.

Gas phase analysis was performed by FTIR on per puff base. A Bruker IFS 66/s FTIR spectrometer (Bruker Optics, Billerica, Mass.) with a linear gas flow cell (Axiom Analytical Inc., Irvine, Calif.) was used. The linear gas flow cell (50 ml volume and 1.0 m path length) was kept at 100° C. to minimize the condensation of gases on KBr windows and on the cell surface. The infrared spectra were collected with 64 scans at a resolution of 0.5 wavenumber and a mirror velocity of 100 kHz. A narrow range liquid nitrogen cooled mercury cadmium telluride (MCT) detector was used for the spectral range of 3800–750 $cm^{-1}$. A fresh small Cambridge pad (9 mm in diameter) was used for each puff and placed at the entrance of the gas flow cell to filter out the particulates and to ensure the reproducibility of each experiment. A single-port smoke machine (KC Automation, Richmond, Va.) was used with a square wave profile, 35 ml volume and 2 seconds duration, and 60 seconds interval between puffs. The gas cell was flushed with nitrogen gas between puffs. 1R4F cigarettes and specially made testing cigarettes with different rod density and porosity were used as the samples. The lighting of the cigarette was performed by using a Borgwaldt electric lighter in a consistent manner. The limit of detection and linearity of detector response were evaluated with formaldehyde standard gas. Several inorganic salts, including potassium bicarbonate ($KHCO_3$, EM Science, (Gibbstown, N.J.), potassium phosphate ($K_2 HPO_4$, J. T. Baker Inc., Phillipsburg, N.J.), sodium chloride and ammonium bicarbonate (NaCl and $NH_4 HCO_3$, Fisher Scientific, Pittsburgh, Pa.), were used without further purification.

Several treatments of the tip portion of cigarette were applied to examine their effectiveness in reducing formaldehyde deliveries in the gas phase of mainstream smoke. These include treating the cigarette tip with different salts, using pure Burley tobacco in the tip, changing the rod density, ventilation, and applying thermal treatment on the tip of tobacco rod. The formaldehyde deliveries were compared with that of a untreated cigarette, or a standard cigarette. It should be pointed out that these FTIR experiments are not designed or intended to precisely measure the deliveries of formaldehyde in the mainstream smoke, rather the FTIR system is used as a quick screening method to evaluate the effects of reducing formaldehyde formation by different treatments on the cigarette tip portion. Indeed, other techniques such as TDL (tunable diode laser infrared spectroscopy) and HPLC (high performance liquid chromatography) are available for the purpose of accurately measuring the total deliveries of formaldehyde. A description of the TDL method for formaldehyde measurement is given below to support the investigation using the FTIR technique.

PAHs are measured using two GC/MS analytical methods. The first is a single puff, semi-quantitative screening technique that was developed to measure the PAH content with good sample throughput. Each puff constitutes one sample replicate. The second is a quantitative method for BaP requiring the smoking of 20 cigarettes per sample replicate and extensive and time-consuming sample cleanup prior to separation and detection by GC/MS.

For the semi-quantitative method the particulate matter from a single puff was collected on a small aluminum foil disc, about 8 mm in diameter, in an impaction trap. The disc was weighed before and after the puff to determine the quantity of particulate matter deposited. The sample deposited and dcollected on the disc then was dissolved in 50 $\mu$L of a 5:5:1 mixture of toluene, hexane, and isopropyl alcohol. The sample/solvent mixture was sonicated at room temperature for 10 minutes and 1 $\mu$L of the solution was injected into a GC-MS in a splitless mode. The GC/MS was a Hewlett-Packard 6890 Series Gas Chromatograph with a DB-17 ms (30 meter×0.25 mm ID×0.25 $\mu$m film thickness) column and a HP 5973 Mass Spectrometer Detector. The MS detector is operated in the selected ion monitoring (SIM) mode and electron impact (EI) ionization is used to generate the ions. Standards are tested to determine the retention time of benzo (a) pyrene under identical chromatographic conditions. The capability of verifying mass spectral patterns as well as chromatographic retention times makes the GC/MS technique a very reliable method for PAH analysis.

For the quantitative method the mainstream smoke from 20 cigarettes was collected onto a pre-weighed 92 mm Cambridge filter pad using a 20-port Borgwaldt smoking machine. Upon completion of the smoking, the pad is weighed to determine the TPM deposited. The filter is extracted with 40 mL of a 7:3 solution of methanol and deionized water for 10 minutes. The solution is twice extracted with 30 mL aliquots of 2:1 hexanes:toluene. A 10 mL aliquot of the combined organic extracts is evaporated down to 1 mL at 50–60° C. The 1 mL concentrate is transferred to a preconditioned $NH_2$ sorbent and eluted with approximately 15 mL of hexanes. The PAH-containing fraction is concentrated down to approximately 1 mL and 1 $\mu$L aliquots of this concentrate are injected for analysis into the same GC/MS as described above. Benzo (a) pyrene is determined by this method.

1. Puff-by-puff Formaldehyde Delivery in Mainstream Smoke

FIG. 1 shows the average amount of formaldehyde in mainstream smoke for different puffs from Kentucky reference IR4F cigarettes using the TDL technique. Formaldehyde in cigarette smoke is measured on a per puff basis using second derivative tunable diode laser (TDL) infrared spectroscopy. An LS-3 spectrometer (Laser Photonics, Wilmington, Mass.) was modified to include a computer-controlled, heated sampling system for handling whole cigarette smoke using a 3-way air-actuated valve and impaction trap (no filter pads) for continuous flow using a laminar flow element with differential pressure transducer and control valve (MKS, Burlington, Mass.). The spectrometer was modified further to accept a 50-cm path length, 0.3 L volume reference gas cell and liquid nitrogen-cooled mercury cadmium telluride (HgCdTe) reference detector containing formaldehyde vapors, and a 13 L volume multipass gas sample cell with the path length set at 16 M and a second liquid nitrogen-cooled HgCdTe detector. The formaldehyde measurement is not different from the results obtained when whole smoke (gas phase and particulate phase) is sampled directly without using the impaction trap. Equivalent results (within ±5%) are obtained for 1R4F cigarette smoke using several different formaldehyde absorption lines in the 2800 $cm^{-1}$ region. These data confirm that it is unlikely that there are any significant interferences present from other components found in the smoke sample. The detection limit of the TDL system is 0.1 ug/puff (obtained at 3$\sigma$) using an actual smoke sample, which is a more demanding determination than using a diluted formaldehyde standard.

When performing the MS smoke analysis, a formaldehyde standard, having a concentration similar to that of the lighting puff delivery of a 1R4F reference cigarette, is measured just prior to each cigarette analysis. The standard is generated continuously at a maximum flow of 180 mL/min. from NIST-traceable paraformaldehyde permeation tubes using the Dyna-Calibrator Model 314 (VICI Metronics Inc., Santa Clara, Calif.). The accuracy of the tubes is certified by Metronics to be within ±2%. The precision of the TDL MS smoke system using these standards is ≦1%.

Cigarette samples are conditioned at 60% relative humidity (RH) and 75° F. for 48 hours and sealed in glass Ball® jars until needed for smoking. The cigarettes are inserted 11 mm into the 3-way valve. Cigarettes are smoked using a square-wave puff profile, with a puff volume of 35.0±0.1 second duration, once every 60±1 seconds. A 35-mL bubble flow meter (R24.00, Heinr. Borgwaldt GmbH, Hamburg, Germany) is used for setting the puff volume. The Kentucky Reference 1R4F is a filtered cigarette that has been provided by the Tobacco and Health Research Institute, University of Kentucky over the years for research purposes. The 1R4F specifications are: 83.5 mm length, 25 mm circumference, 35 mm butt length, 10.6 mg/cigt total particulate mater (TPM), 28% filter ventilation, 27.2 mm filter length, filter RTD (resistance to draw) of 117 mm of water, and total cigarette RTD of 134 mm of water. The 1R4F is smoked to a 35 mm butt length.

The puff-by-puff formaldehyde deliveries for ten determinations of 1R4F, using the heated sampling system with an impaction trap, are given in Table 1. The average formaldehyde cigarette delivery based on ten determinations of one cigarette each is 27±5 μg/cigt., having a relative standard deviation (RSD) of 17%. The first puff (12±2μg) accounts for 44% of the total delivery. The averages with standard deviations for each puff are shown in FIG. 1.

2. Inorganic Salt Treatments

The formaldehyde formation from cellulose pyrolysis and the effects of inorganic salts on cellulose pyrolysis have been studied. Tar was found to be the major precursor of formaldehyde formation in cellulose pyrolysis, and additions of some inorganic salts were found to affect the relative yields of char and tar, and therefore the formation of formaldehyde. Cellulose is a major component in a cigarette, accounting for about 20% of the dry weight of the tobacco and for over 70% of the weight of the wrapping paper. Factors affecting formaldehyde formation in cellulose pyrolysis also may have similar effects on formaldehyde deliveries in cigarette smoke.

Figure 2:
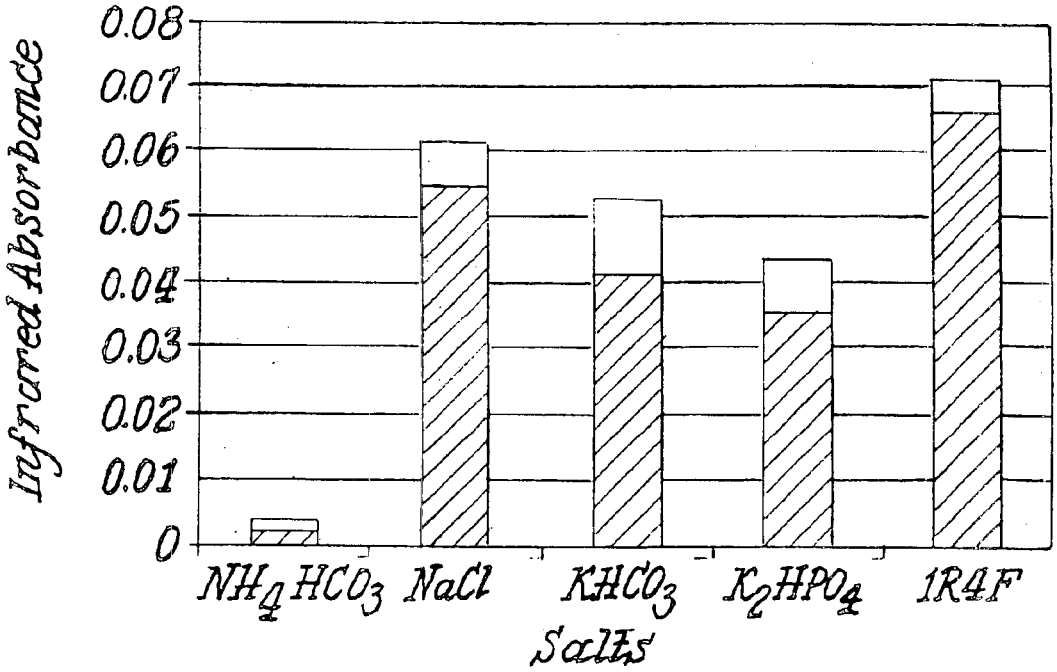
FIG. 2 is a graph showing infrared absorbance of formaldehyde in the first puff of 1R4F cigarettes with different salts on the tobacco rod tip.

FIG. 2 shows a comparison of the formaldehyde detected in the first puff of IR4F cigarettes, with and without salt treatments. Three to five cigarettes were tested for each group, and both the infrared absorbance (which is directly related to the concentration of formaldehyde) and the standard deviation were shown in the figure. Four different inorganic salts were tested here. Instead of using the traditional aqueous solution method, such as spraying a salt solution onto the tobacco shreds and then removing the solvent and leaving the salt on the tobacco, a small amount of solid salt powder was simply added to the tip of the cigarettes. This approach of directly adding a small amount of solid salt on the tip of a tobacco rod simplifies the procedure and introduces minimum perturbation on the cigarette. The cigarette then was lighted and the gas phase FTIR spectrum recorded in a consistent manner. Among the four salts applied, including ammonium bicarbonate ($NH_4HCO_3$), sodium chloride (NaCl), potassium bicarbonate ($KHCO_3$), and potassium phosphate ($K_2HPO_4$), the $NH_4HCO_3$ salt was the most effective in reducing formaldehyde formation in the first puff, yielding more than 90% reduction compared with that of an untreated IR4F cigarette. Addition of NaCl, $KHCO_3$, and $K_2HPO_4$ on the cigarette tips also helped to reduce formaldehyde formation, but to a lesser extent. Even though the statistical uncertainties due to the variations among the treated cigarette samples and the difficulties in lighting the cigarettes consistently are observed, the effectiveness of these three salts on reduction of formaldehyde formation is consistent with their known catalysis properties as flame retardants in cellulose pyrolysis and combustion studies. The much higher reduction of formaldehyde by $NH_4HCO_3$ salt is due to the additive effect of this salt as a condensed phase flame retardant, like the other three salts, as well as the gas phase reaction of $NH_3$, which is produced by $NH_4HCO_3$ on heating, with formaldehyde at elevated temperatures. Preferably, the treated zone or bands as described above are approximately 3 to 7 mm, if the treatment is to be limited to the first puff. The band would be wider if treatment were to include the second puff location along the rod, or more.

3. Different Types of Tobacco on Cigarette Tip

A typical American-type blended cigarette contains four types of tobacco, referred to are Virginia (Bright), Burley, Maryland, and Oriental. Detailed comparisons of the major chemical characteristics of the four tobacco types have been published. Burley tobacco is characterized as having low sugars and has relatively high nitrogen content producing more $NH_3$ in smoke.

Figure 3:
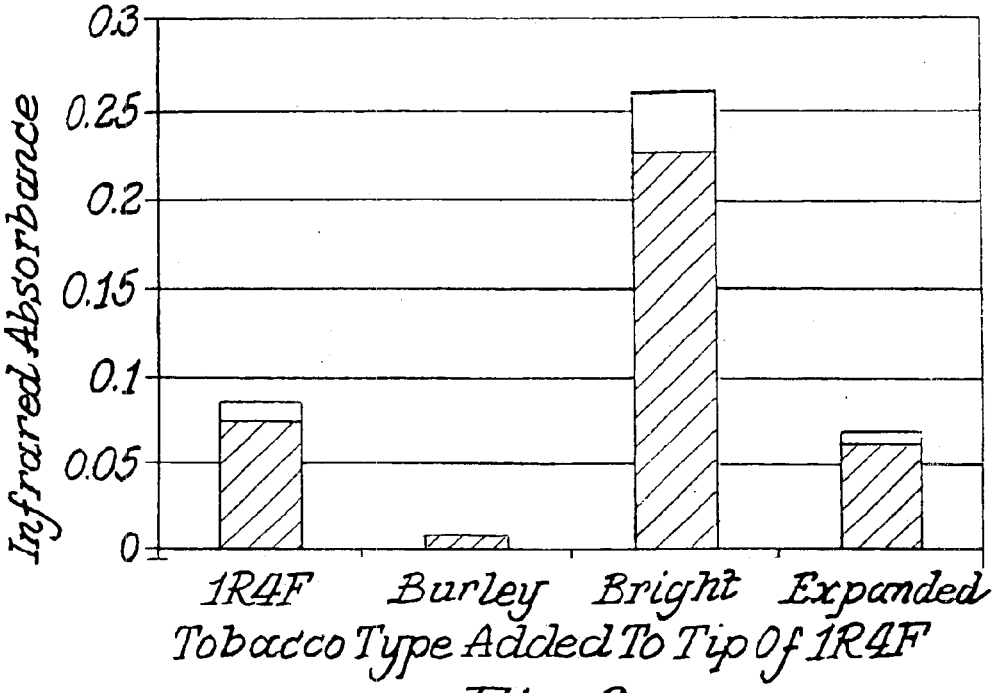
FIG. 3 is a graph showing infrared absorbance of formaldehyde in the first puff of 1R4F cigarettes with rod tip replaced by different tobacco types.

To further investigate the role of $NH_3$ in reduction of formaldehyde in mainstream smoke, pure burley tobacco shreds were used to replace the tip portion of IR4F cigarettes (about the first 5 mm from the tip of cigarette rod), and compared the formaldehyde deliveries with that of a control 1R4F cigarette. Similar treatments with pure Bright tobacco and expanded tobacco were performed and the data, together with that of Burley and control 1R4F, are displayed in FIG. 3. The tobacco was cut into sizes similar to that of a regular IR4F cigarette shreds. To minimize the variance resulting from repacking the cigarette tips, the tobacco shreds of IR4F were removed and repacked into the tip portion of the cigarettes. The data for 1R4F cigarette shown in FIG. 3 was from such repacked cigarettes. As shown in FIG. 3, applying Burley tobacco in the tip reduced the formaldehyde delivery, a reduction of more than 80% in the first puff compared with the control IR4F cigarette. This reduction of formaldehyde is attributed to two possible factors: 1) gas phase reaction of $NH_3$ with formaldehyde or its precursor(s), and 2) low sugar content in Burley tobacco, since sugar is known to produce formaldehyde in smoke. It is possible that some type of Maillard reaction products are formed, which also would account for the aroma flavor detected in cellulose pyrolysis with $NH_3$ doped carrier gas. It is interesting to note that replacement of Bright tobacco in the tip portion of a IR4F cigarette caused a large increase of first puff formaldehyde delivery. Again, this may be caused by the high sugar and low nitrogen content in Bright tobacco. Tobacco expanded with $CO_2$ did not yield significant change on the first puff formaldehyde delivery.

4. Effect of Thermal Treatment on Tobacco

Figure 4:
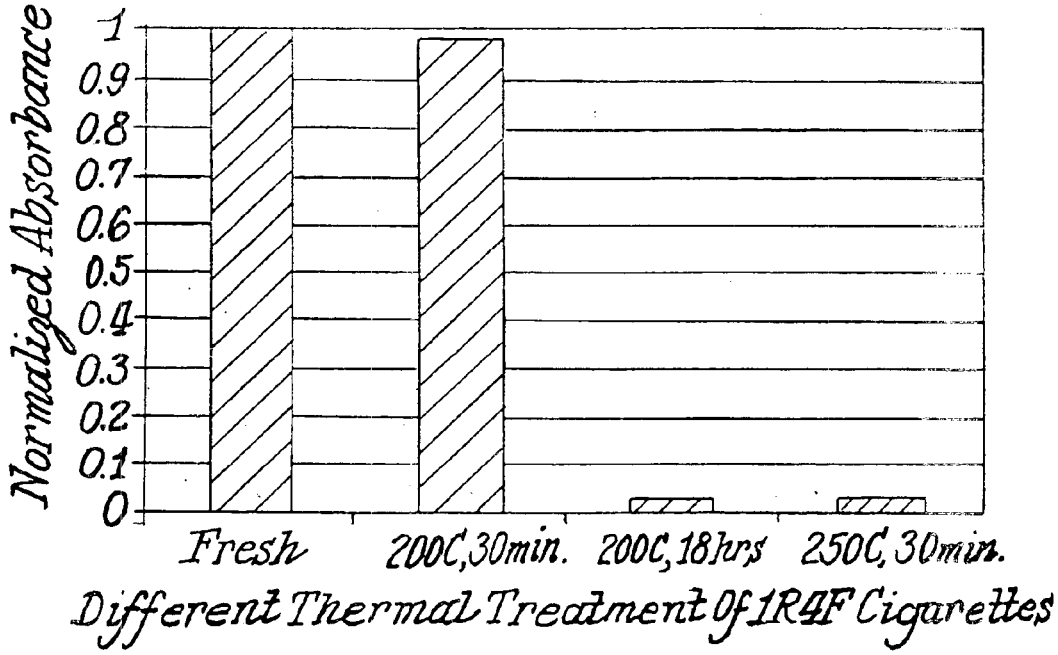
FIG. 4 is a graph showing normalized absorbance of formaldehyde in the first puff of mainstream smoke of 1R4F cigarettes after different thermal treatment.

The unique differences between the first puff and all other puffs of a cigarette explains the gas phase formaldehyde detected on a per puff base. The first puff (lighting puff) is significantly different from the rest of the puffs. One such difference is that only fresh tobacco is burned at the lighting puff, while during the static burn after the coal is established or after the first puff, the tobacco behind the coal is exposed to elevated temperature. In other words, the tobacco is thermally treated and no longer fresh before the next puff. The existence of the coal provides a high temperature source that pre-treats the tobacco shreds. When the next puff is started, the tobacco consumed is not fresh. FIG. 4 shows the first puff mainstream gas phase formaldehyde detected when the tobacco rod was fresh, tip portions treated at 200° C. for 30 minutes, 200° C. for 18 hours, and 250° C. for 30 minutes. The infrared absorption of each sample was normalized with that of the fresh tobacco in this figure for easier comparison. The same lighting method was used for all samples. It is clear from the FIG. 4 that with some simple thermal treatment of the tobacco rod tip, the final amount of formaldehyde detected in the gas phase of the mainstream smoke of the first puff can be greatly affected greater than a 90% reduction. Apparently, the thermal exposure of the cigarette rods somehow changed the tobacco composition (probably to have some char formed, as indicated by the darker color after thermal treatment) and consequently the smoke chemistry when the cigarettes were smoked. A similar thermal treatment effect on formaldehyde formation was observed in the study of cellulose pyrolysis, where thermally treated cellulose was found to produce up tp 90% less formaldehyde. Cigarettes treated at 150° C. for 20 hours do not show any significant reduction of formaldehyde.

5. Effects of Tobacco Rod Density and Wrapper Porosity

Figure 5:
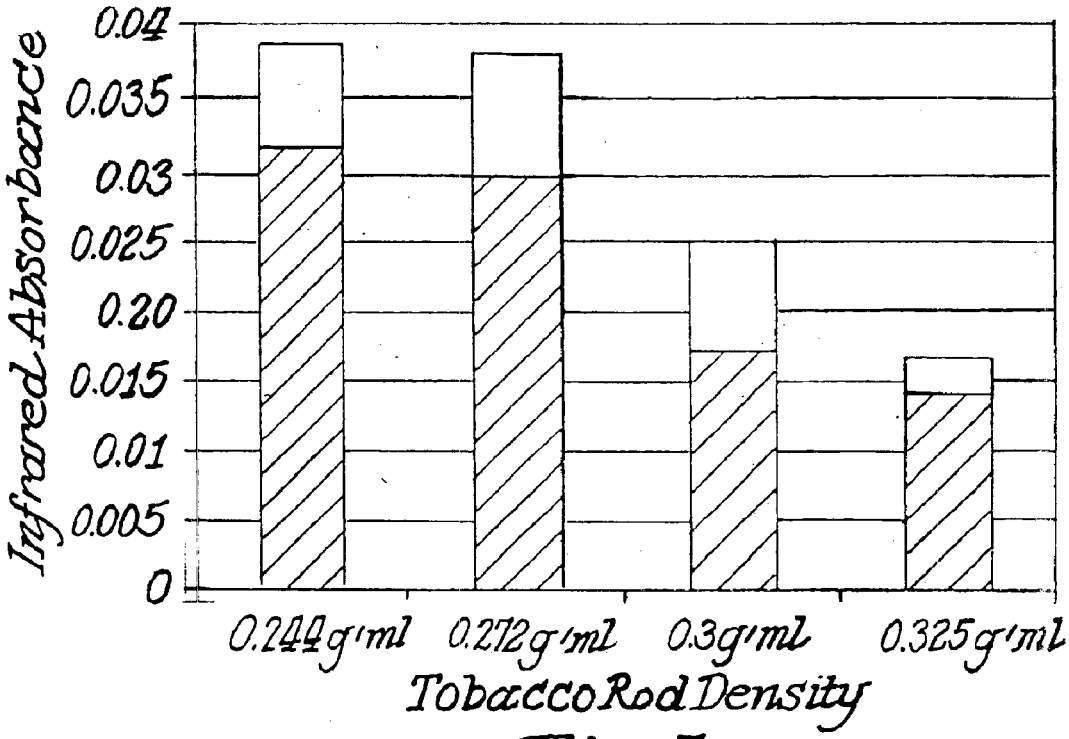
FIG. 5 is a graph showing infrared absorbance of formaldehyde in the first puff of mainstream smoke of cigarettes with different tobacco rod densities (gram/ml)
Figure 6:
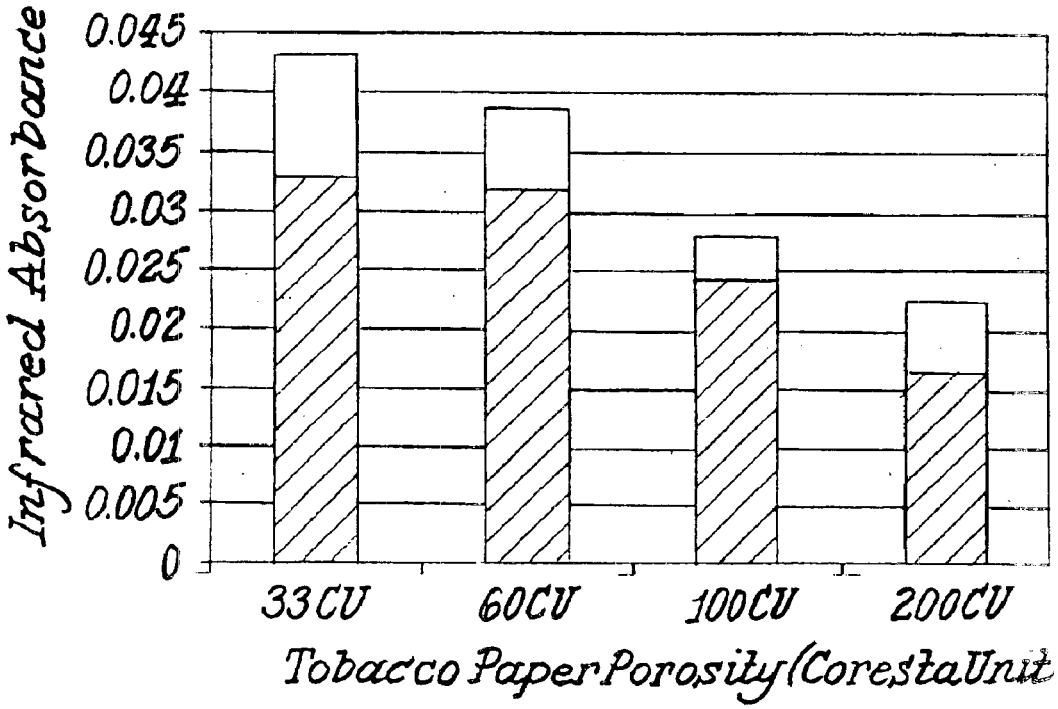
FIG. 6 is a graph showing infrared absorbance of formaldehyde in the first puff of mainstream smoke of cigarettes with different paper porosity (Coresta Unit)

FIG. 5 shows the first puff formaldehyde deliveries from specially made cigarettes with different rod densities. The ventilation levels of the filter and the wrapping paper were kept constant. It is clearly seen that as the tobacco rod density increased by 0.244 g/ml to 0.325 g/ml, the formaldehyde delivery decreased by approximately 50% on the first puff. FIG. 6 shows the effect of changing the wrapping paper porosity on the formaldehyde delivery. At a constant tobacco rod density, the formaldehyde delivery decreased by approximately 50% on the first puff as the wrapping paper porosity increased by 33 to 200 Coresta Units (CU). Rod density and paper porosity are important factors affecting the flow dynamics, resistance to draw (RTD), and the coal temperature. As the rod density and paper porosity increase, the air drawn into the coal (or the tip portion of tobacco rod in the case of first putt) decreases. The reduction of air flow reduces both the coal temperature, which could greatly affect the smoke chemistry and the product of tobacco detected in the gas phase. Formaldehyde is a relatively high temperature combustion product of tobacco, and its delivery would be reduced at lower coal temperature as in the case of high rod density and paper porosity. To further demonstrate the effect of ventilation on the formaldehyde delivery, an increase of the ventilation level of the tobacco rod was made by applying a string of holes (about 0.5 mm m diameter, 20 holes) at different distances from the tip of the tobacco rod. FIG. 7 shows the first puff formaldehyde deliveries with addition of the holes at different positions from the tip of tobacco rod of IR4F cigarettes. Clearly, additional ventilation holes reduced the formaldehyde formation, and as the holes are moved further away from the tip, greater reductions of formaldehyde from the first puff were observed. This is straight forward because since as the holes move away from the tip, more dilution through the holes and consequently, more reduction of air flow through the tip portion would be expected. Again, the reduction of air flow through the tip portion of tobacco rod could reduce the coal temperature and the amount of tobacco materials burnt, both of which reduce formaldehyde delivery in mainstream smoke.

6. Effects of Lighting Source on PAHs and B(a)P Deliveries

Figure 8:
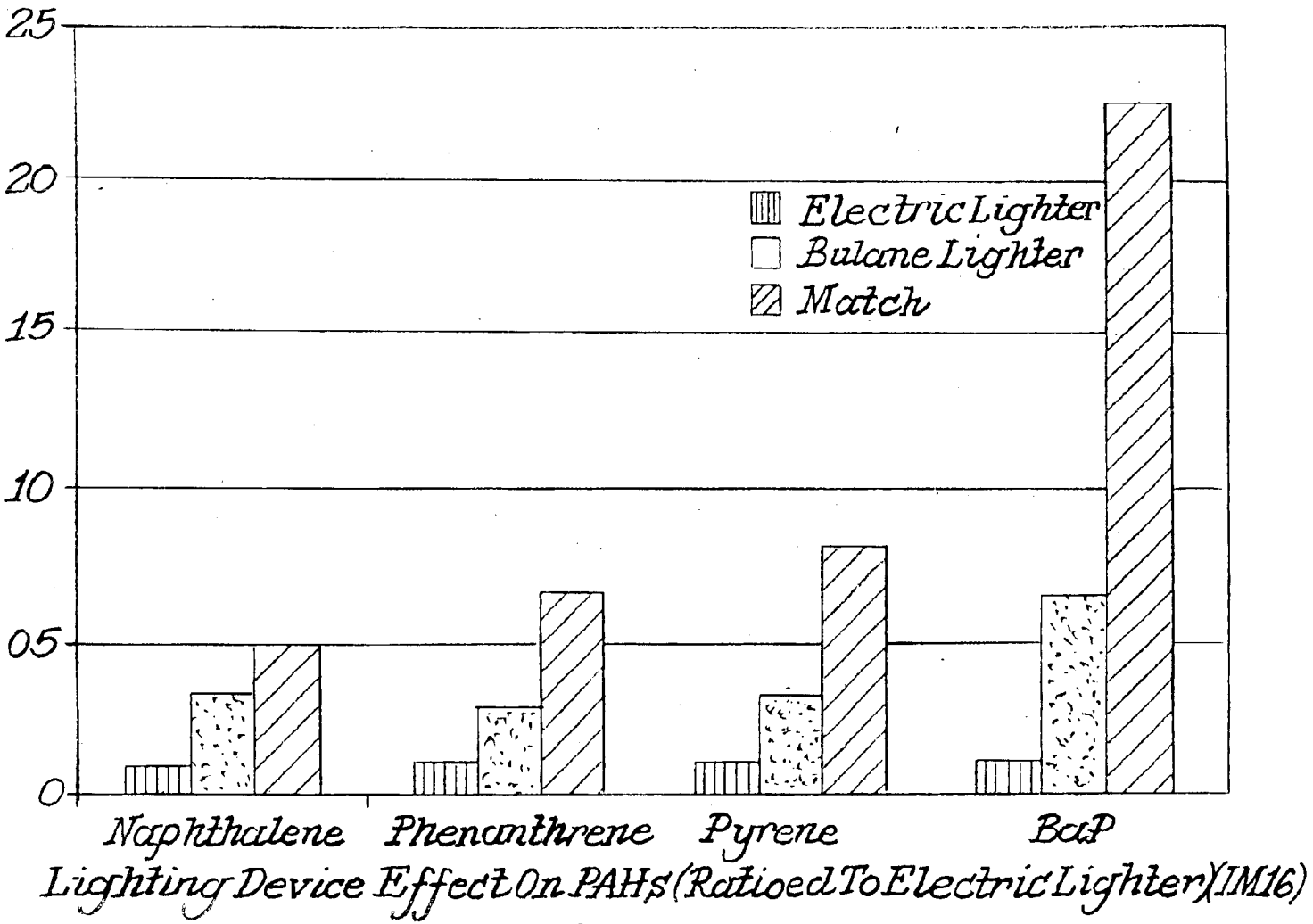
FIG. 8 is a graph showing the effect of electric, butane, and match lighting devices on the PAHs of naphthalene, phenanthrene, pyrene, and benzo(a)pyrene (BaP) first puff deliveries (ratioed to electric lighter results) of IM16.
Figure 9:
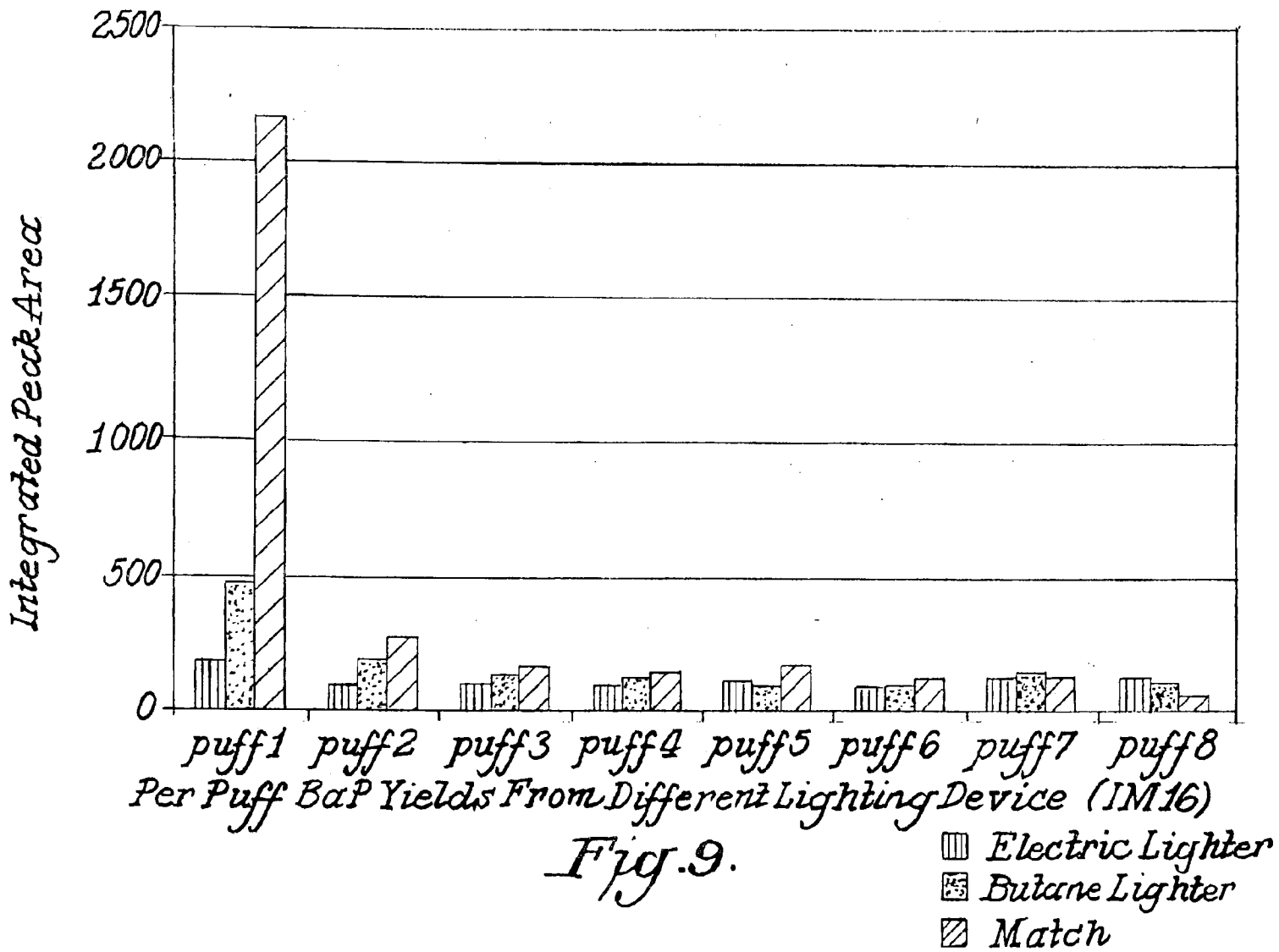
FIG. 9 is a graph showing the effect of electric, butane, and match lighting devices on the benzo(a)pyrene (BaP) per puff deliveries (infrared integrated peak area) of IM16.

When an IM16 (an industrial monitor, blended, non-ventilated cigarette) is lit with a match or butane lighter, the PAHs of naphthalene, phenanthrene, pyrene, and benzo(a) pyrene increase compared to an electric lighter as shown in FIG. 8 for the first puff. These data are obtained using the single puff, semi-quantitative GC/MS method described previously. BaP is increased two-fold on a cigarette or TPM (total particulate matter) basis by lighting with a match or butane lighter as shown in Table II. The data presented in Table II are obtained using the multiple cigarette, quantitative GC/MS method previously described. It is believed that this increase in PAHs is a result of the effect of the lighter on the first puff, as shown in FIG. 9 for BaP, and is reduced by eliminating direct contact of the tip of the cigarette with the yellow flame by modification of cigarette.

The results in Table III using the single puff, semi-quantitative GC/MS method show that PAHs, including BaP, are reduced in the lighting puff of IM16 cigarettes modified 1) with ventilation holes placed 3 mm from the cigarette tip, and 2) with a carbon-based disc placed at the tip. The experiments are performed using a butane lighter and the percent reductions are calculated based on results obtained using unmodified IM16 cigarettes as the control. Such modifications of the cigarette reduce the levels of PAHs in the first puff using a yellow flame lighting source. The carbon-based materials may have absorption properties that contribute to the reduction of PAHs, as well as acting to alter the natural flow patterns during the lighting process.

Modifications to the cigarette to reduce PAHs include replacing the tobacco in the tip with an alternate fuel source that produces no or very little PAHs, blocking the end with a thin (~1 mm) circularly shaped carbon-based and/or metallic disc placed on the tip, placing ventilation holes at the tip, or placing a catalyst in the filler at the tip end.

7. Diagrams of Cigarette Rod Modifications

Figure 10A:
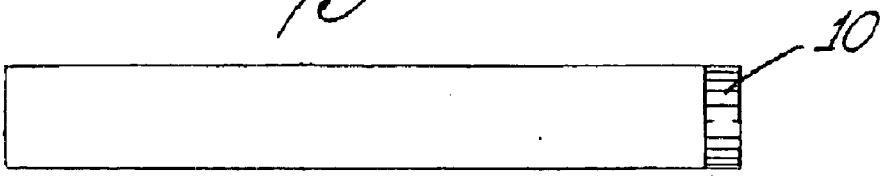
FIGS. 10A through 10F schematically show six different approaches for modifying a cigarette where in FIG. 10A, the tobacco at the tip is replaced or modified as described previously, in FIG. 10B, the outer wrap has been modified chemically, in FIG. 10C, a section of reconstituted tobacco treated with ammonium salts is attached to the tip, in FIG. 10D, ventilation holes in the paper are placed near the tip, in FIG. 10E, resistance to draw (RTD) is increased by blocking the tip somewhat using either a section of reconstituted sheet or metal foil, and in FIG. 10F, the cigarette is modified by placing an attenuator at a predetermined location along its length where the target smoke constituent is maximum.
Figure 10B:
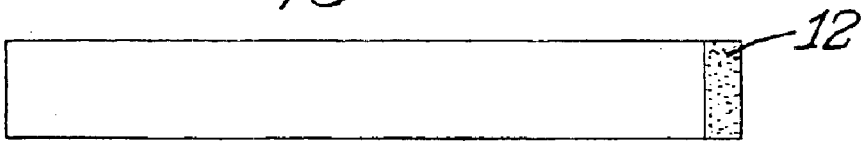
Figure 10C:
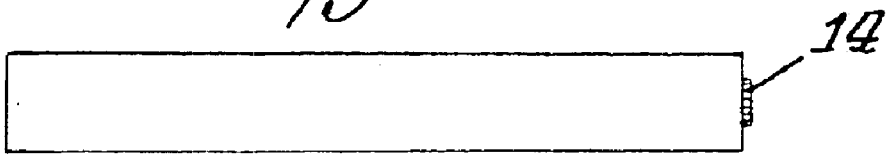
Figure 10D:
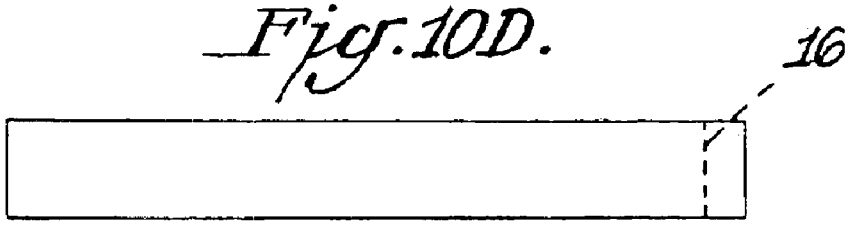
Figure 10E:
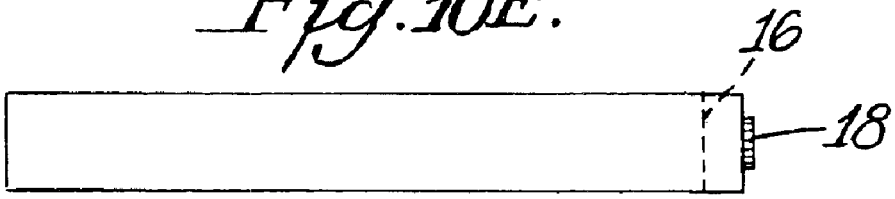
Figure 10F:
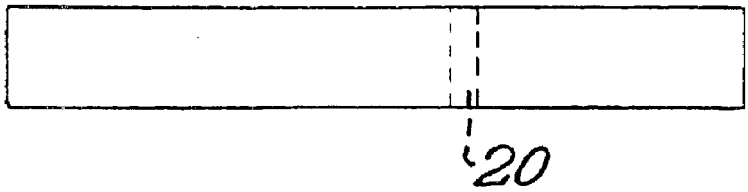

The approaches taken to modify a cigarette are shown in FIGS. 10A through 10F where in FIG. 10A, the tobacco at the tip 10 of the cigarette is either replaced or modified as described previously, in FIG. 10B, the outer wrap 12 has been modified chemically, in FIG. 10C, a section of reconstituted tobacco 14 treated with added ammonium salts is attached to the tip of the cigarette, in FIG. 10D, ventilation holes 16 are placed near the tip, in FIG. 10E, resistance to draw (RTD) is increased by blocking the end with either reconstituted tobacco or metal foil 18, and in FIG. 10F, the cigarette is modified by placing an attenuator 20 at a predetermined location along its length where the target (predetermined) smoke constituent is maximum.

Referring to FIG. 11A benzo(a)pyrene (BAP) and formaldehyde may be partially abated by placing a small carbon-based and/or metallic patch 22 at the tip of cigarette 24. The patch 22 is smaller than the cross-sectional area of the cigarette. Upon lighting the cigarette, it is believed the patch 22 conducts heat away from the coal and restricts airflow thereby partially abating production of BAP and formaldehyde.

Other constructions having similar abatement results are shown in FIGS. 11B through 11F. FIG. 11B shows a carbon-based and/or metallic disc 26 with flavorants and/or ammonium salts 28 associated with the disk fitted within a recess 30 at the tip of cigarette 24. FIG. 11C shows a patch of reconstituted tobacco mat 32, preferably of a type having an elevated level of ammonium salts. Also, the paper at the tip end of the cigarette 10 in FIG. 11C may include or be coated with magnesium ammonium phosphate and a row of circumferential perforations 36 may be provided in the paper at the tip end. In another embodiment shown in FIG. 11D a tape of tacky reconstituted tobacco or an aluminum clip 38 may be attached to the cigarette tip for the abatement of BAP and formaldehyde.

FIG. 11E shows the tip end of cigarette 24 with a coating of magnesium ammonium phosphate 34 and a carbon-based and/or metallic patch 27 at the end. Lastly, FIG. 11F shows the tip end of cigarette 24 with a row of perforations 36 and a tobacco patch 32 at the end.

TABLE I

Puff-by-Puff Formaldebyde Deliveries for IR4F Cigarettes

| Replicates Puff No. | A Cig. | B Cig. | C Cig. | D Cig. | E Cig. | F Cig. | G Cig. | H Cig. | I Cig. | J Cig. | MEAN μg | STD DEV μg | RSD % |
|---|---|---|---|---|---|---|---|---|---|---|---|---|---|
| 1 | 15.0 | 12.4 | 11.7 | 13.0 | 9.0 | 11.6 | 11.8 | 13.1 | 10.8 | 10.2 | 11.9 | 1.7 | 14 |
| 2 | 2.2 | 2.0 | 2.1 | 2.5 | 2.0 | 1.5 | 2.2 | 2.2 | 1.6 | 1.6 | 2.0 | 0.3 | 16 |
| 3 | 2.4 | 1.8 | 1.6 | 1.9 | 1.1 | 1.7 | 1.4 | 1.6 | 1.2 | 1.7 | 1.6 | 0.4 | 22 |
| 4 | 1.8 | 1.2 | 1.5 | 1.4 | 1.3 | 2.2 | 1.6 | 1.4 | 2.0 | 1.5 | 1.6 | 0.3 | 20 |
| 5 | 2.2 | 1.7 | 1.7 | 1.5 | 1.2 | 1.5 | 1.4 | 1.5 | 2.2 | 1.7 | 1.7 | 0.3 | 20 |
| 6 | 2.1 | 2.0 | 1.3 | 1.5 | 1.3 | 1.8 | 1.4 | 1.6 | 1.7 | 1.2 | 1.6 | 0.3 | 19 |
| 7 | 1.5 | 1.7 | 1.8 | 1.8 | 1.3 | 2.4 | 1.6 | 1.8 | 2.1 | 1.5 | 1.8 | 0.3 | 17 |
| 8 | 2.7 | 1.8 | 2.4 | 2.0 | 1.6 | 3.2 | 1.7 | 1.9 | 2.9 | 1.7 | 2.2 | 0.6 | 26 |
| 9 | 4.6 | 2.0 | 4.8 | 2.0 | 1.5 | 8.8 | 2.1 | | | 1.8 | 3.4 | 2.5 | 73 |
| μg/cigt | 34.4 | 26.7 | 28.8 | 27.6 | 20.4 | 34.5 | 25.1 | 25.0 | 24.4 | 23.1 | 27.0 | 4.6 | 17 |
| μg/puff | 3.8 | 3.0 | 3.2 | 3.1 | 2.3 | 3.8 | 2.8 | 3.1 | 3.0 | 2.6 | 3.1 | 0.5 | 16.0 |
| puff count | 9.0 | 9.0 | 9.0 | 9.0 | 9.0 | 9.0 | 9.0 | 8.0 | 9.0 | 9.0 | 8.8 | 0.4 | 4.8 |

TABLE II

Lighting Device Effect on BaP for IM16 and 1R4F Cigarettes

| | | Match | Butane Lighter | Electric Lighter |
|---|---|---|---|---|
| IM16 | | | | |
| BaP (ng/cig) | Average | 25.5 | 20.4 | 11.6 |
| | Stdev | 3.2 | 2.9 | 2.1 |
| TPM (mg/cig) | | 17.0 | 17.3 | 17.1 |

TABLE II-continued

Lighting Device Effect on BaP for IM16 and 1R4F Cigarettes

| | | Match | Butane Lighter | Electric Lighter |
|---|---|---|---|---|
| Ratio (to electric lighter) | | 2.2 | 1.8 | 1.0 |
| 1R4F | | | | |
| BaP (ng/cig) | Average | 18.1 | 16.1 | 8.6 |
| | Stdev | 0.5 | 1.8 | 2.1 |
| TPM (mg/cig) | | 10.4 | 10.2 | 9.9 |
| Ratio (to electric lighter) | | 2.1 | 1.9 | 1.0 |

TABLE III

Percent Reduction of PAHs for IM16 Cigarettes Modified with Ventilation Holes at the Tip and with a Carbon-Based Disc Placed at the Tip

| | Naphthalene | Phenanthrene | Pyrene | Fluoranthene | Benzo(a)-Pyrene |
|---|---|---|---|---|---|
| HOLES | | | | | |
| Average | 30 | 40 | 50 | 50 | 50 |
| Stdev | 10 | 2 | 7 | 3 | 1 |
| CARBON TIP | | | | | |
| Average | 30 | 50 | 50 | 50 | 60 |
| Stdev | 21 | 10 | 29 | 29 | 40 |

We claim:

1. A cigarette having a tobacco rod wrapped in paper, the tobacco rod having a location along its length where a smoke constituent is maximized, and an inhibitor/attenuator of the smoke constituent solely at that location, and wherein the remainder of the cigarette is substantially free of said inhibitor/attenuator.

2. A cigarette as in claim 1 wherein the smoke constituent is an aldehyde.

3. A cigarette as in claim 1 wherein the smoke constituent is formaldehyde.

4. A cigarette having a tobacco rod wrapped in paper, and ammonium bicarbonate on the paper over a portion along its length where a smoke constituent is maximized, and wherein the remainder of the paper is substantially free of ammonium bicarbonate.

5. A cigarette comprising a tobacco rod, said tobacco rod comprising tobacco, a wrapper and ammonium bicarbonate at a location along the tobacco rod where a smoke constituent is maximized, and wherein the remainder of the tobacco rod is substantially free of said inhibitor/attenuator.

* * * * *